US005615668A

United States Patent [19]

Panz et al.

[11] Patent Number: 5,615,668

[45] Date of Patent: Apr. 1, 1997

[54] APPARATUS FOR COOLING COMBUSTION CHAMBER IN A SUBMERGED COMBUSTION HEATING SYSTEM

[75] Inventors: Eric Panz, West Vancouver; Steven E. Panz, North Vancouver, both of Canada

[73] Assignee: Inproheat Industires Ltd., Vancouver, Canada

[21] Appl. No.: 215,596

[22] Filed: Mar. 22, 1994

[51] Int. Cl.[6] ..... F24H 1/20

[52] U.S. Cl. ..... 126/360 A; 126/368; 122/31.2

[58] Field of Search ..... 126/360 R, 348, 126/360 A, 366, 367, 368; 122/31.2, 31.1, 509, 14, 17; 431/160, 158

[56] References Cited

U.S. PATENT DOCUMENTS

| | | | |
|---|---|---|---|
| 3,368,548 | 2/1968 | Santoleri | 126/360 A |
| 3,568,658 | 3/1971 | Brock | 126/360 A |
| 3,794,015 | 2/1974 | Vietz | 126/360 A |
| 4,570,612 | 2/1986 | Ripka et al. | 126/360 A |

FOREIGN PATENT DOCUMENTS

| | | | |
|---|---|---|---|
| 0003177 | 7/1979 | European Pat. Off. | 126/360 A |
| 0014143 | 1/1982 | Japan . | |

*Primary Examiner*—Carl D. Price

*Attorney, Agent, or Firm*—Oyen Wiggs Green & Mutala

[57] ABSTRACT

This invention is directed to a submerged combustion system comprising: (a) tank means for holding liquid, the tank means having a liquid inlet and a liquid outlet, and an exhaust gas outlet; (b) combustion chamber means positioned in at least a portion of the interior of the tank means; (c) means in the combustion chamber for enabling fuel and air to be introduced into the combustion chamber and being ignited to create a hot gaseous combustion product; (d) port means located in the combustion chamber means for enabling the hot gaseous combustion product to be exhausted from the interior of the combustion chamber into the tank means; (e) means for controlling the level of liquid in the tank means so that the hot gaseous combustion product passes through the liquid and the liquid heated by the hot gaseous combustion product is withdrawn from the tank means, and unheated liquid is introduced into the tank means through the liquid inlet; and (f) cooling liquid means located at the upper region of the combustion chamber and spills over the top edges of the combustion chamber and runs down the outer walls of the combustion chamber until the cooling liquid reaches the top level of the liquid being heated by the hot gaseous combustion product.

5 Claims, 9 Drawing Sheets

APPARATUS FOR COOLING COMBUSTION CHAMBER IN A SUBMERGED COMBUSTION HEATING SYSTEM

FIELD OF THE INVENTION

This invention relates to a novel submerged combustion system. More particularly, this invention relates to a novel submerged combustion system which can be installed singly or in combination with other similar submerged combustion systems to heat large quantities of liquids and solutions.

BACKGROUND OF THE INVENTION

Submerged combustion is a method of heating whereby hot products of combustion are forced through a solution to heat the solution. The heat exchange occurs directly between the hot products of combustion and the solution. In a submerged combustion system, the hot combustion products are generated by a flame which is typically fed by a combination of air and natural gas. The flame does not come into contact with the solution. This technology differs from conventional heat exchange methods such as immersion tube heating where the heat exchange is indirect and the products of combustion are exhausted directly to the atmosphere, rather than being forced through the solution. Submerged combustion can be utilized to heat liquids with overall system efficiency greater than 90%. Conventional hot water boiler heating systems have an efficiency of about 80% while immersion tube systems have an efficiency of about 70%.

In applications where separation of components by distillation or absorption is required, submerged combustion can be applied to provide liquid temperatures up to about 195° F.

In addition to high efficiency, submerged combustion systems are advantageous because they maintain a uniform temperature throughout the solution in which the submerged combustion is conducted. The hot combustion products keep the solution in constant agitation. Submerged combustion systems are also suitable for heating contaminated liquids. Expenses are usually lower because the submerged combustion can be conducted in a tank which need not be pressurized. Unlike boiler heating applications, a certified operating engineer is not required to operate a submerged combustion system.

Typical industrial applications for submerged combustion systems include: (a) natural gas processing plants—effluent pond heating; (b) municipal effluent holding and treatment ponds—maintenance of pond temperatures to ensure continuous high level of biological degradation especially in regions that experience extreme seasonal temperature changes; (c) aggregate wash plants—heating aggregate wash water at concrete batch plants; (d) log ponds and conditioning chests—heating log ponds and conditioning vats in plywood, veneer, orientated strand board (OSB), waferboard, chopstick plants; (e) pulp and paper—mill water intake protection against freezing, white water solution heating; (f) heap leach mining—heating of barren solutions for ore extraction in heap leaching operations; (g) wet potash mining—heating of barren brine solution to maximize solubility and recovery of potash in flooded potash mines; (h) coal thawing for conveying; (i) carpet and fabric manufacturing—heating of bulk carpet and fabric dyes; (j) cogeneration—evaporation of waste water to recover water treatment chemicals in plants with zero effluent discharge; and (k) industrial processes—processes requiring large volumes of hot water or non-flammable liquids, or processes requiring a direct source of heat for distillation or absorption.

Typical commercial applications for submerged combustion systems include: (a) swimming pool heating—institutional and residential; (b) fish hatcheries—fresh water heating; (c) commercial laundries—wash water heating; (d) automotive car washes; (e) snow disposal; and (f) food processing plants.

SUMMARY OF THE INVENTION

The invention is directed to a submerged combustion system comprising: (a) tank means for holding liquid, the tank means having a liquid inlet and a liquid outlet, and an exhaust gas outlet; (b) combustion chamber means positioned in at least a portion of the interior of the tank; (c) means in the combustion chamber for enabling fuel and air to be introduced into the combustion chamber and being ignited to create a hot gaseous combustion product; (d) port means located in the combustion chamber means for enabling the hot gaseous combustion product to be exhausted from the interior of the combustion chamber into the tank means; (e) means for controlling the level of liquid in the tank means so that the hot gaseous combustion product passes through the liquid and the liquid heated by the hot gaseous combustion product is withdrawn from the tank means, and unheated liquid is introduced into the tank means through the liquid inlet; and (f) cooling liquid means located at the upper region of the combustion chamber, the combustion chamber which extends above the level of the liquid in the tank means being cooled by a cooling water which is introduced into the cooling liquid means in the top region of the combustion chamber, and spills over the top edges of the combustion chamber and runs down the outer walls of the combustion chamber until the cooling liquid reaches the top level of the liquid being heated by the hot gaseous combustion product.

In the system, the cooling liquid means can be a hollow circular chamber and the cooling liquid can be introduced into the circular chamber at the top region of the combustion chamber by a pipe which causes the cooling liquid to circulate in a vortex pattern around the top of the circular chamber.

In the system, the elevation of the top of the circular chamber can be adjusted relative to the elevation of the combustion chamber means.

In the system, the cooling liquid means can be constructed so that it has the configuration of a hollow toroid created by a pair of parallel circular plates, with respective circular openings in the respective centers thereof, the parallel plates being spaced from one another, and the exterior circumferences of the two parallel circular plates being joined by an outer cylinder plate, and the interior circular openings of the two circular plates being joined by an inner cylinder of smaller diameter than the outer cylinder, the inner cylinder and the outer cylinder being arranged in an annular configuration.

In the system, the nozzle means for combining fuel and air for combustion can be positioned in the interior of the inner cylinder.

In the system, the cooling liquid is water which is introduced into the interior annular volume of the cooling chamber and exits over a lip around the top of the water circumference of the outer cylinder, and the cooling water flows down the outer surface of the combustion chamber.

In the system, the elevation of the lip can be adjusted to regulate the amount of cooling liquid flowing over the lip.

DRAWINGS

In drawings which illustrate specific embodiments of the invention but which should not be construed as limiting or restricting the spirit or scope of the invention in any way:

DETAILED DESCRIPTION OF SPECIFIC EMBODIMENTS OF THE INVENTION

Figure 1:
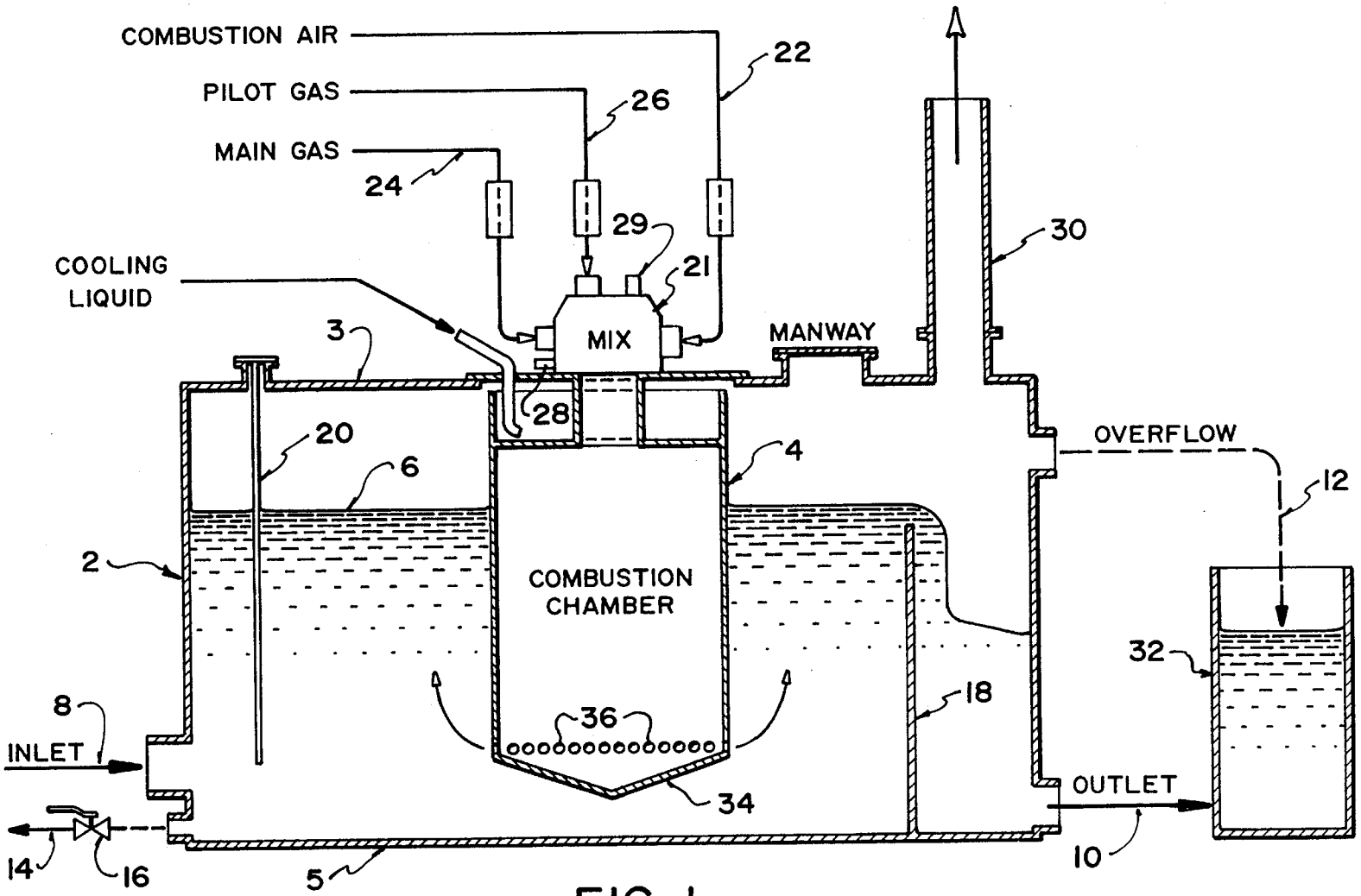
FIG. 1 illustrates a schematic side view of a submerged combustion system.

Referring to FIG. 1, which illustrates a schematic side partial section view of a submerged combustion system, the system comprises a liquid holding tank 2 which has a flat top 3 and flat bottom 5. In most cases, the tank 2 has a basic cylindrical construction. Extending downwardly in the central area of the tank 2 through an opening in the top plate 3 is a narrow cylindrical hollow combustion chamber 4. The combustion chamber 4 can be removed for maintenance. The construction of this combustion chamber 4 will be discussed in detail below.

The liquid level in the liquid holding tank 2 is depicted by liquid line 6. Liquid to be heated by submerged combustion is introduced through process inlet 8, as indicated by the arrow, and exits from the interior of the liquid holding tank 2 via process outlet 10, as also indicated by an arrow. One side of the tank 2 is fitted with a process overflow outlet 12, which coincides with the maximum upper limit tolerance level of the liquid level 6. A tank drain 14 with a valve 16 is located in the lower region of one wall of the tank 2 and permits the contents of the tank to be drained from time to time.

A liquid level control weir 18 is constructed on one side of the interior of the tank 2 and encloses the process outlet 10. The top level of the weir 18 is located below the bottom of the process overflow outlet 12, and is also usually below the liquid level 6. The overflow outlet 12 is used for emergencies. A bubble tube type liquid level sensor 20 extends downwardly from the top 3 of the tank 2 into the interior of the liquid holding tank 2 and below the liquid level. If the sensor 20 detects a predetermined unacceptable liquid level change, it will initiate burner shut-down.

Combustion air is delivered to the nozzle mix burner 21 at the top of the combustion chamber 4 by means of combustion air inlet line 22, which has a control valve. The air is delivered under pressure. Main natural gas for the nozzle mix burner 21 is delivered under pressure by a main natural gas line 24. As a general rule, 10 to 12 volumes of air are introduced per 1 volume of natural gas, in order to obtain complete and efficient combustion. A separate pilot gas line 26 is also connected to the nozzle mix burner 21. The pilot gas is used to establish a "minimum main flame". A spark type ignitor 28 extends into the interior of the nozzle mix burner 21 and is used to ignite the pilot gas flame. An electronic flame scanner or flame rod 29 detects the presence of the minimum and also a main flame. After the minimum main flame is detected by the scanner 29, the combustion air delivered through line 22 and main natural gas delivered through line 24, are mixed and injected through the nozzle burner 21, to thereby produce a large vertical "main flame" which burns in the interior of the combustion chamber 4.

Hot gaseous combustion products for heating the liquid are created by burning the combustion air and main natural gas in the interior of the combustion chamber 4. These hot gaseous products of combustion are expelled from the interior of the combustion chamber 4 through ports 36 located in the bottom region of the combustion chamber 4, and are expelled horizontally through the liquid 6. After discharge through the ports 36, the hot products of combustion are in the form of a multitude of very hot gas bubbles (approximately 3000° F.) with very low density. These bubbles in total have a vast surface area. The bubbles rapidly shrink under the hydrostatic head of the liquid 6 and due to cooling as they rise in the liquid, and energy is exchanged into the liquid 6 to thereby heat the liquid while at the same time cooling the bubbles. After the hot gaseous products of combustion have passed upwardly through the liquid 6, as a dispersion of tiny bubbles, they are exhausted from the interior of the tank 2 through exhaust outlet 30 at the top of the tank 2, as indicated by the arrow. When operating efficiently, all of the surplus heat in the gases will have been extracted and the temperature of the exhaust gas 30 will be about the same as the temperature of the outlet solution 10. Heated process fluid is discharged into a liquid seal tank 32 to prevent hot gases exiting to atmosphere except through the exhaust 30.

Figure 2:
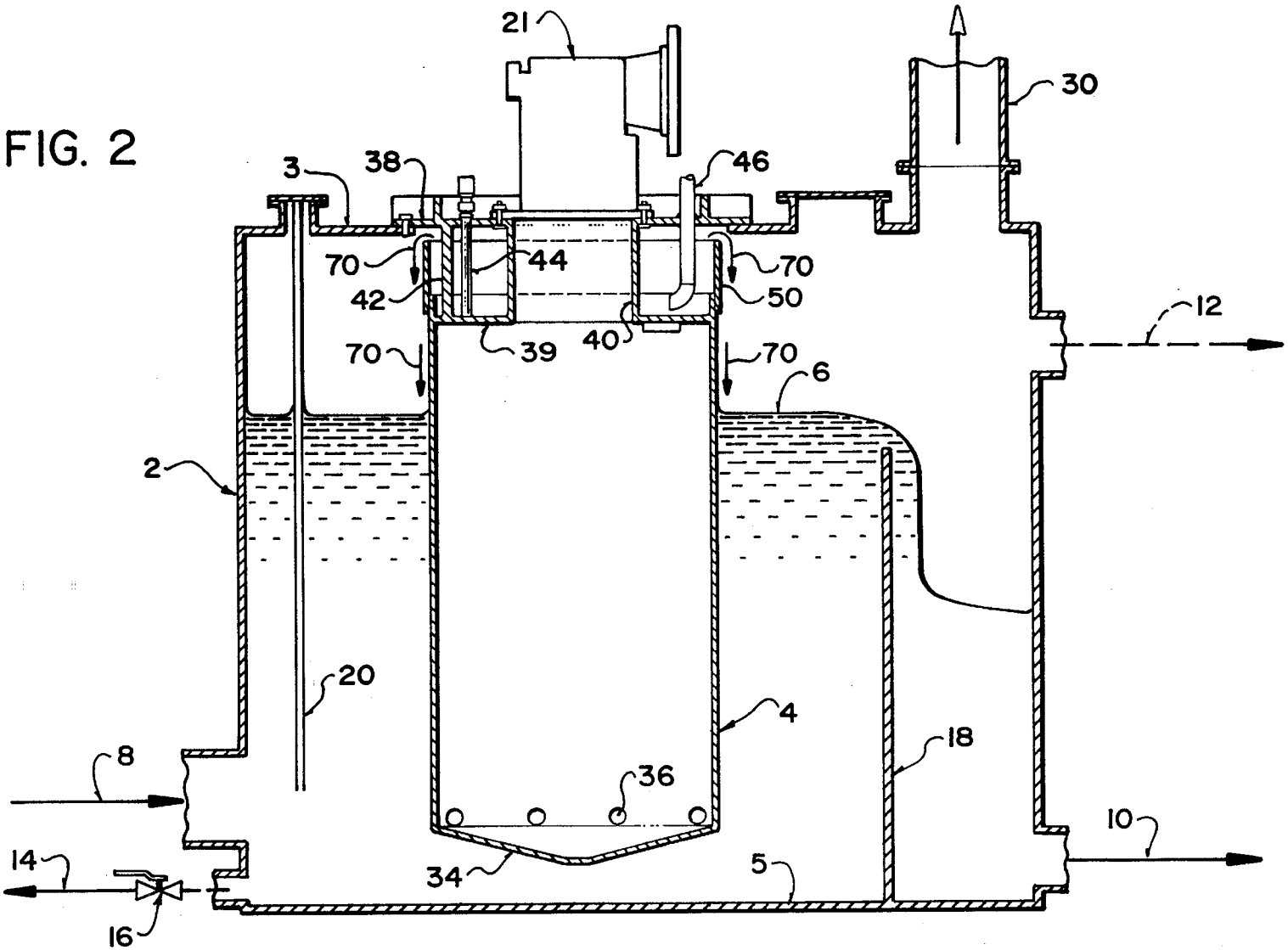
FIG. 2 illustrates an elevation section view of a submerged combustion system tank with a submerged combustion chamber installed in the interior thereof.

FIG. 2 illustrates an elevation section view of a submerged combustion system tank 2 with a partially submerged combustion chamber 4 in the interior thereof. The dimensions of the tank 2 and the dimensions of the combustion chamber 4 are sized so that maximum solution heating efficiency is obtained. The diameter of the tank 2 is approximately 3.5 times the diameter of the combustion chamber 4. We have found that this ratio minimizes metal requirements while at the same time maximizing heat transfer, liquid heating, and hot liquid circulation. There are no liquid "dead spots". FIG. 2 illustrates a number of circular ports 36 at the bottom of the sides of the chamber 4. These ports 36 dispell the hot combustion products into the liquid in the form of tiny bubbles. The burner nozzle housing 21 is positioned at the top of the combustion chamber 4, and connects with sleeve 40. The lower end of liquid level sensor 20 is submerged in the liquid 6 as indicated by dotted liquid level line 6. FIG. 2 illustrates some of the detail of the construction of the top and bottom of the combustion chamber 4. These details will be discussed more fully below. In FIG. 2, the cooling water which flows down the upper outer walls of chamber 4 on all sides is indicated by arrows 70.

Figure 3:
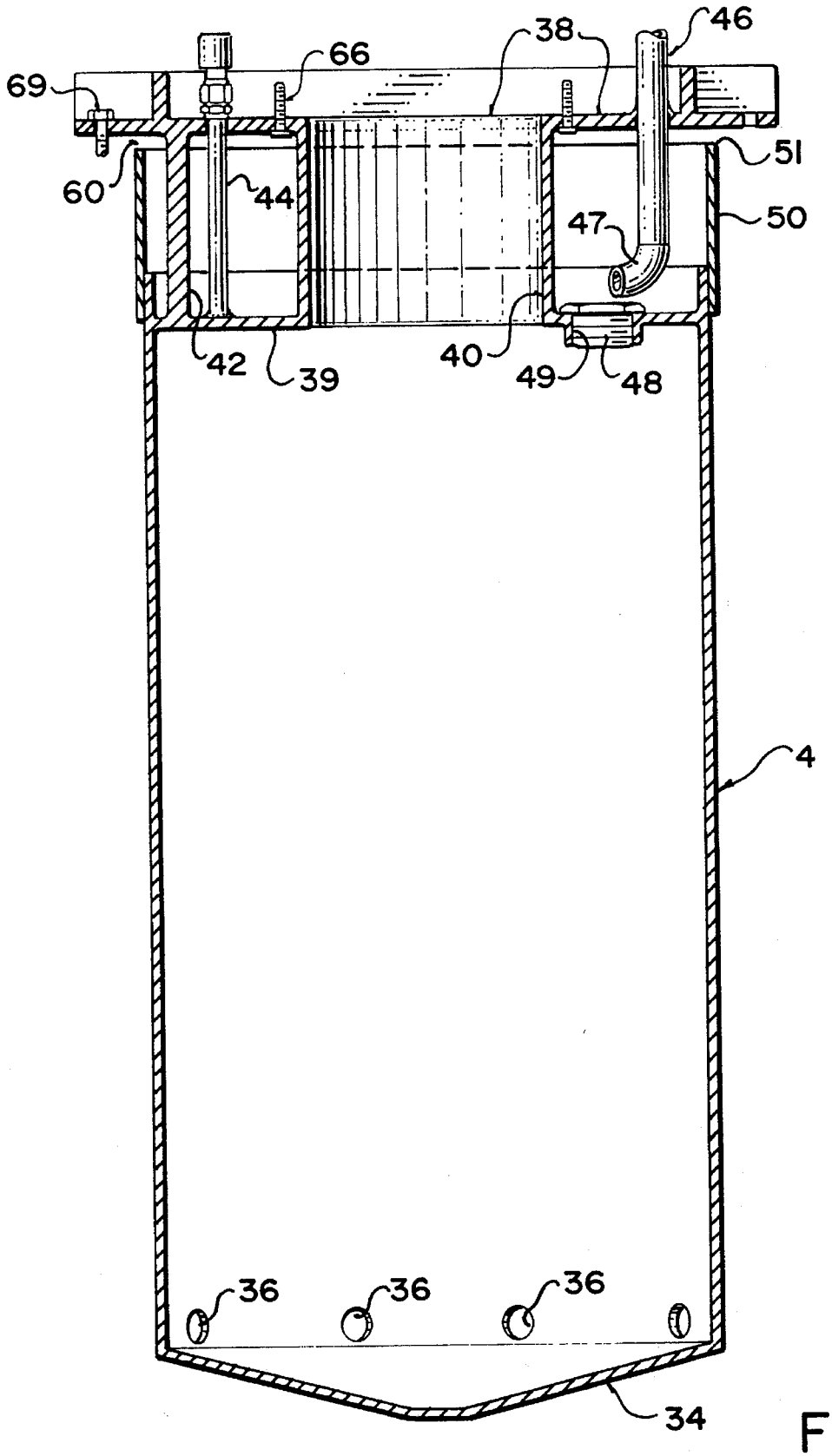
FIG. 3 illustrates an enlarged elevation section view of a combustion chamber.

FIG. 3 illustrates a side section view of a combustion chamber 4 which is depicted in general in FIG. 1 as combustion chamber 4. As shown, the height of the combustion chamber 4 is approximately three times its horizontal diameter. These dimensions coordinate with the dimensions of the tank 2 (not shown) and permit rapid gas-air mixing and an efficient combustion flame (not shown) to emit downwardly from the top of the chamber 4 without touching the interior walls of the chamber 4 or the liquid. It is important that the flame does not touch the cold walls or the liquid during operation because this reduces efficiency, leads to corrosion problems, and could "cold shock" extinguish the flame. Typically, the flame will be at about 3000° F. while the solution being heated will be between about 70° F. to about 160° F. The combustion chamber 4 is constructed in the shape of a hollow cylinder and has an inverted conical plate 34 welded or bolted to the bottom of the chamber. A series of gas combustion products exit ports 36 are formed around the circumference of the base of the combustion chamber 4, and will be discussed in greater detail below.

The top portion of the combustion chamber has a flat top plate 38 welded to the burner sleeve 40, which in turn is welded to the roof 39 of the combustion chamber 4. The periphery of the roof 39 is welded to the interior of the cylindrical side walls of the combustion chamber 4.

The volume space defined by the top plate 38, the exterior of the cylindrical burner sleeve 40 and the roof 39 is enclosed by a cylindrical adjustable elevation girdle 50 which is fitted to the exterior of the top end of the exterior walls of the combustion chamber 4. The girdle 50 in combination with the top plate 38, roof 39 and sleeve 40 define a "doughnut-like" hollow space, through which the cooling water is circulated.

The top plate 38 and the roof 39 of the combustion chamber 4 have a series of vertical support rods 42 welded to the underside of top plate 38 and the top of roof 39 of the combustion chamber 4, to prevent the development of adverse bending moments, which might be created by the long combustion chamber and bubble eruptions through the ports 36. A thermo-couple assembly 44 with the thermo-couple making contact with the roof 39 of combustion chamber 4 senses temperature and provides protection against overheating. A pipe and elbow unit 46 is constructed in the interior of the "doughnut", and serves to introduce cooling fluid in a tangential direction within the hollow interior of the "doughnut". This cooling fluid, by means of tangential introduction, swirls in a vortex pattern around the interior of the "doughnut" and spills over the top lip 51 of the girdle 50 and down the outsides of the combustion chamber 4 and ultimately into the liquid 6 confined in the interior of the tank 2 (see FIG. 1).

When the system is in a dynamic state, the level of the liquid 6 extends part way up the exterior walls of the chamber 4. The exposed walls above the liquid 6 must be cooled so that extreme temperature differences are avoided. If there were no cooling water spilling over the outsides of the upper walls, the internal flame at 3000° F. would heat the exposed walls of the chamber 4 above the liquid 6 to destructive melt temperatures, while the bottom submerged portion of the walls would remain at the temperature of the liquid which is typically about 70° F. to 160° F.

Figure 4:
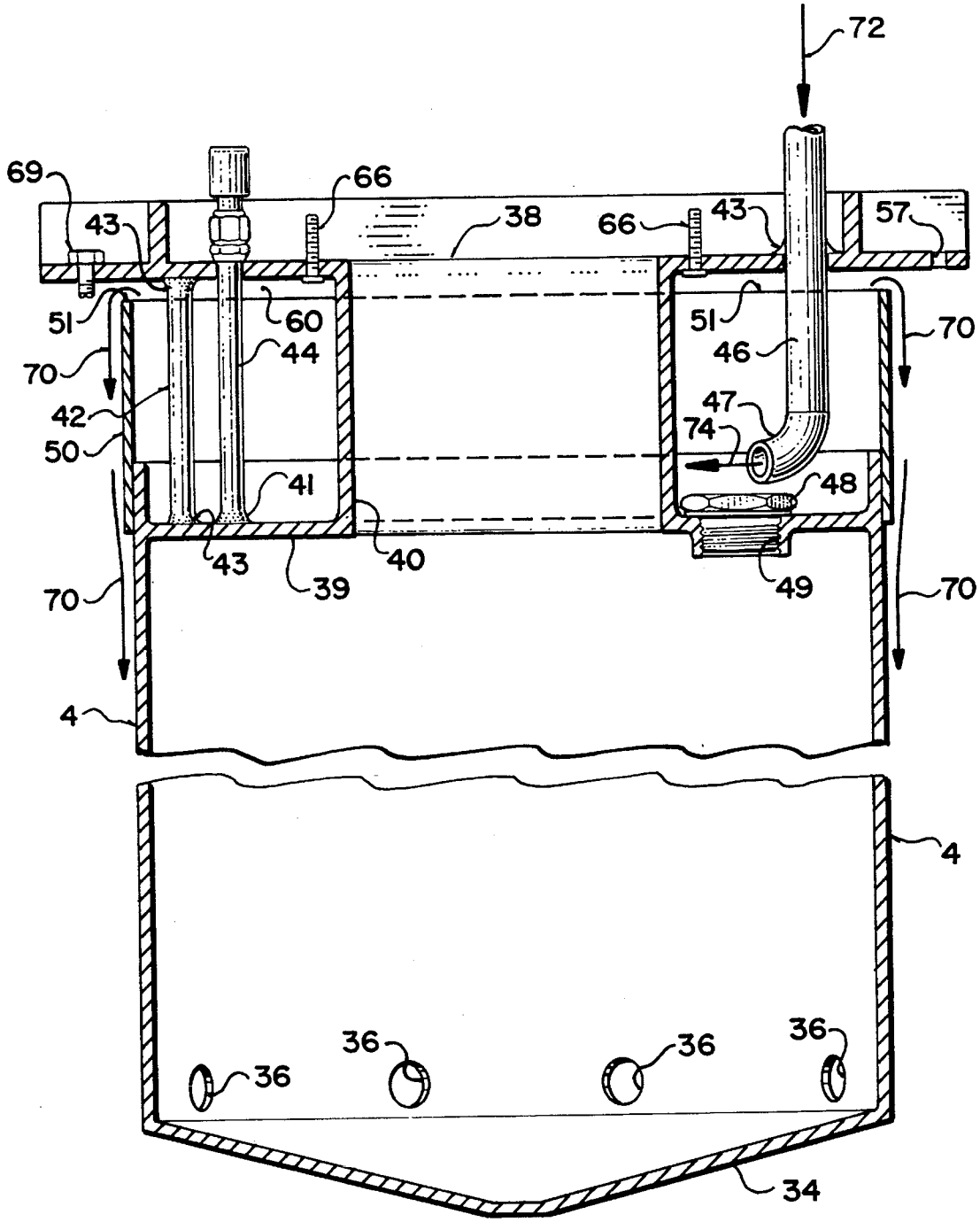
FIG. 4 illustrates a truncated elevation section view of the top and bottom parts of a combustion chamber.

FIG. 4 illustrates a truncated section view of the bottom and top portions of a combustion chamber 4. The inverted conical shape of the bottom 34 is a unique feature of the submerged combustion system. It is constructed so that steam bubbles which collect on the bottom of the conical bottom 34 are encouraged to migrate upwardly and radially outwardly along the bottom surface of conical bottom 34. The bubbles then do not collect on the bottom surface of the conical bottom 34. Such bubbles, if they remain in position, would permit overheating and oxidizing of the bottom of the combustion chamber 4. Prior constructions of combustion chambers have had flat bottoms, or recessed bottoms, which are easy and inexpensive to manufacture. However, flat bottom combustion chambers have been known to oxidize in relatively short order and have had to be replaced on a frequent basis. The inverted conical design of the bottom 34 of the applicant's design is a unique feature and greatly prolongs the life of the combustion chamber 4. Gas bubbles are discouraged by the inverted conical design from collecting on the bottom surface of the chamber bottom 34, and overheating and subsequent oxidation is minimized.

The construction of the "doughnut" formed by the sleeve 40, top plate 38, roof 39 and girdle 50, is shown in more detail in FIG. 4. The "doughnut" contains cooling fluid which cools the burner sleeve 40 and roof 39 of the top end of the combustion chamber 4. The cooling fluid also spills over the exterior surface of the upper walls of the combustion chamber 4, above liquid level 6. The design of the "doughnut" is a unique feature of the combustion chamber 4 of the invention. The vertical thermo-couple 44 is welded in place to roof 39 of the interior of the "doughnut" by welds 41. Likewise, the plurality of vertical stabilizer rods 42 (one is shown) are located in place between the underside of the top plate 38 by welds 43 and the top of the roof 39, and tangentially to the inside of the top interior walls of the combustion chamber 4 (see FIG. 5). The cooling water in-flow pipe 46, which has at the bottom an elbow 47, which directs in-flow cooling water tangentially into the interior of the hollow "doughnut", is welded to top plate 38 by welds 43. A clean-out plug 48, which is accessible to an operator from the top of the chamber 4, and enables the operator to clean accumulated debris from the "doughnut", is screwed by male threads into female threaded receptacle 49, which is welded to the periphery of a hole in the roof 39. Another unique feature of the design of the cooling water "doughnut" is that the girdle 50 can be raised or lowered relative to the upper edge of combustion chamber 4, and top plate 38. Thus the flow of cooling water down the outer sides of the upper walls of chamber 4 can be adjusted by raising or lowering the girdle 50 and thus the amount of cooling water that spills in water-fall fashion over lip 51.

Sleeve 40 replaces the sleeve which is normally found on a commercial burner. The burner 21, with its sleeve removed, fits on the sleeve 40 and is mounted in place by bolt 66. The cooling water being introduced into pipe 46 and elbow 47 is indicated by arrow 72. The water being introduced into the interior of the "doughnut" at a tangent is indicated by arrow 74.

Figure 5:
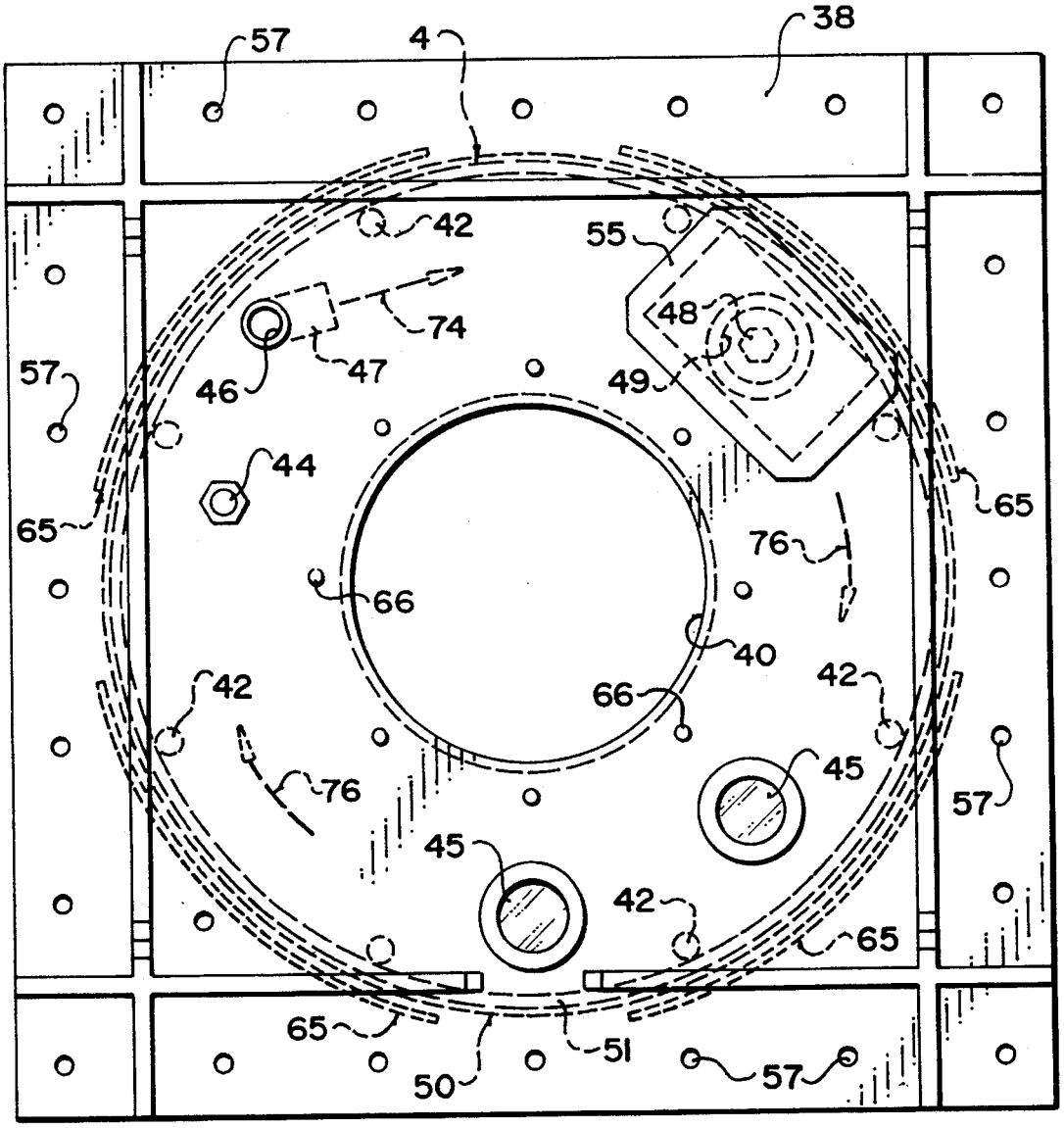
FIG. 5 illustrates a plan view of a combustion chamber.

FIG. 5 shows a top view of the combustion chamber 4 (shown in dotted lines) and the square steel top plate 38 which indirectly connects the top of the chamber 4 to the top 3 of the tank 2 (see FIGS. 1 to 4). The semi-tangential orientation of elbow 47 can be seen at the top left of the FIG. 5. Cooling water introduced through elbow 47 (indicated by arrow 74) is forced to swirl tangentially around the interior of the "doughnut" (indicated by arrows 76), thereby keeping the cooling water in constant circulation, and the sleeve 40 and roof 39 of the "doughnut" cool. The upper end of the burner sleeve 40 fits against the base of a standard nozzle mix burner which is located above the sleeve. A standard burner is available from Maxon Corporation Muncie, Ind. The cooling water spills over the lip 51 of the top of the girdle 50. A removable manhole-cover plate 55, which is constructed above the clean-out plug 48 and threaded coupling 49, is shown at the top right of FIG. 5. The top of thermo-couple 44 is shown at the left of the "doughnut". The vertical and inclined "peep-sights" 45 are illustrated at the bottom of FIG. 5 and permit the operator to climb up on top 3 of the tank 2 and view the interior of the chamber 4 and the flame action in the interior of the combustion chamber 4.

FIG. 5 also illustrates in dotted line configuration the circumference of the combustion chamber 4, the exterior cylindrical girdle 50 of the "doughnut", which slides vertically upwardly or downwardly on combustion chamber 4 and segmental deflectors 65 (see also FIG. 6) which contain stray cooling liquid. A series of equally spaced support rods 42 are distributed around the interior of the periphery of the combustion chamber 4. The steel plate 38 is secured to the top of the tank 2 by a spaced array of bolts 69 (see FIG. 4) which pass through bolt holes 57.

Figure 6:
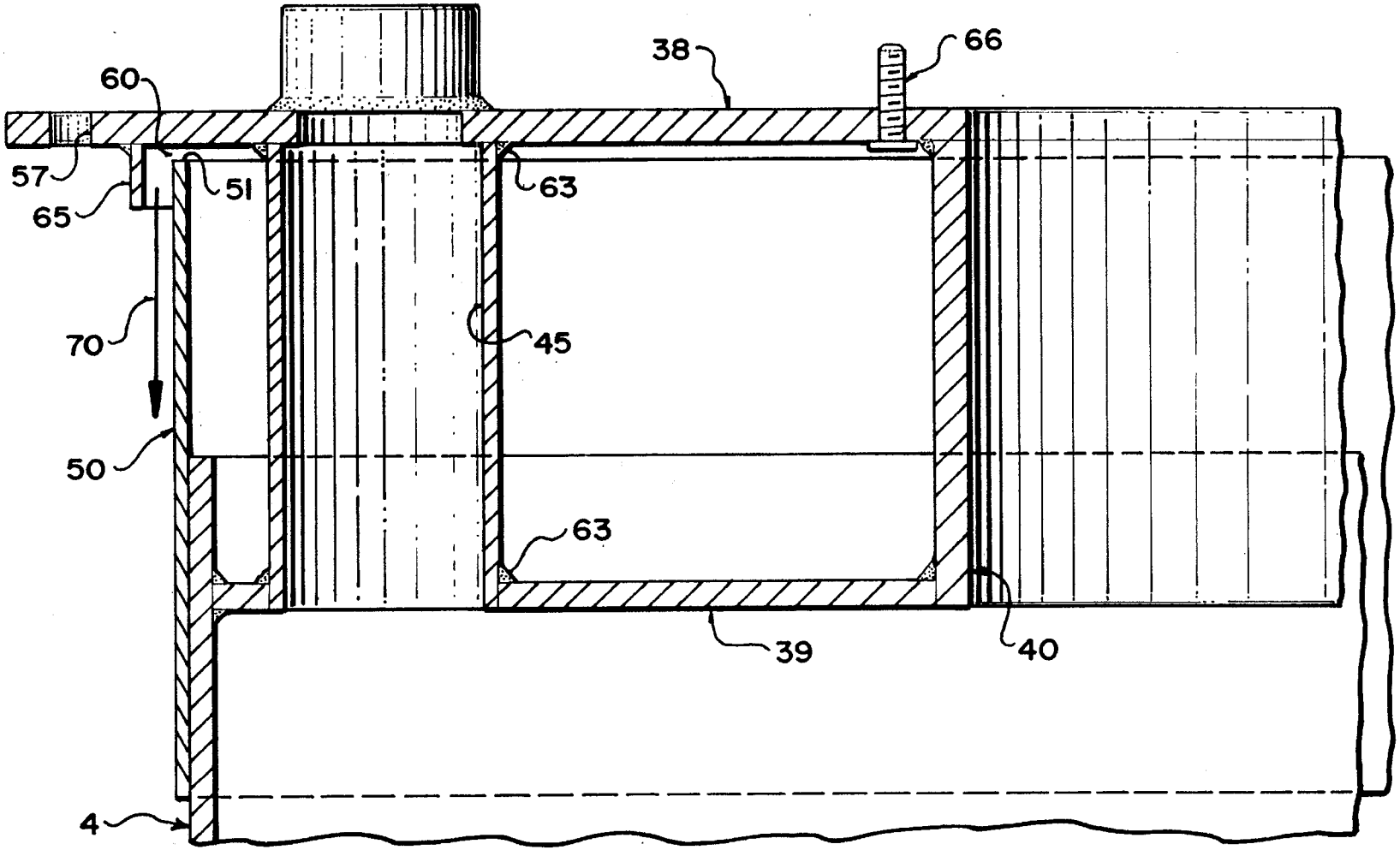
FIG. 6 illustrates a side section detail of a top corner of combustion chamber.

FIG. 6 illustrates a cross-section detail of a top left portion of the combustion chamber 4 and the "doughnut". The cylindrical hollow "peep sight 45" is vertically positioned and penetrates through the interior of the "doughnut" and is held in place by welds 63. As can be seen in FIG. 6, there is a small opening 60 between the top plate 38 and the top lip 51 of the girdle 50 of the "doughnut". Once the girdle 50 of the "doughnut" has been adjusted to the proper elevation in association with the top edge of combustion chamber 4, and cooling water is introduced into and is circulated in the interior of the "doughnut", the cooling water spills over the top lip 51 of the girdle 50 through opening 60 and flows down the outer side walls of the upper region of the combustion chamber 4. This is indicated by arrow 70. This cooling liquid provides a cooling effect on the top regions of the combustion chamber 4, which are above the liquid level 6, when the submerged combustion system is in operation. The cooling liquid keeps the temperature of the combustion chamber 4 relatively uniform throughout its height, above the liquid level 6. An outer downwardly projecting segmented deflector 65, which is of a broken ring-like configuration (see FIG. 5), is fastened to the underside of the top plate 38, and surrounds the opening 60. This deflector 65 induces the cooling fluid to travel downwardly and flow down the outside wall of the girdle 50 and the upper outer regions of the combustion chamber 4. If deflector 65 were not in place, some of the tangentially flowing cooling water would project or spray outwardly and therefore would not contact the outer surface of the combustion chamber 4. The cooling effect of some of the cooling liquid would be lost if all of the liquid did not contact the outer walls. Lip 51 should be leveled around its circumference so that opening 60 is uniform throughout and cooling water in turn is uniformly distributed over the exterior upper surface walls of combustion chamber 4.

Figure 7:
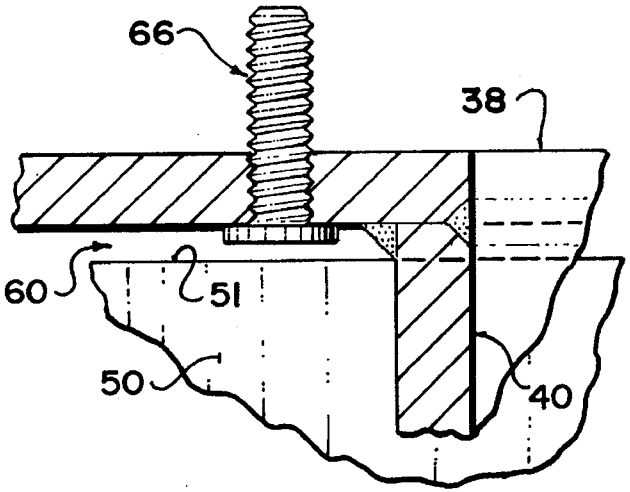
FIG. 7 illustrates an enlarged side section view of the top right region of the part of the combustion chamber illustrated in FIG. 6.

FIG. 7 illustrates a section detail of the top left part of FIG. 4 and illustrates the way in which the top region of the inner wall of the burner sleeve 40 is welded to the top plate 38 of the combustion chamber. A portion of the water gap 60 is also visible in detail shown in FIG. 7. Mounting bolt 66 for mounting the burner (not shown) in place on sleeve 40 is also shown in section.

Figure 9:
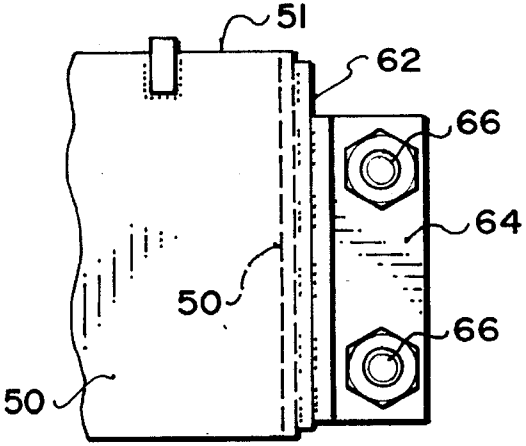
FIG. 9 illustrates a side view of a connection joint of a girdle for the top portion of a combustion chamber.
Figure 10:
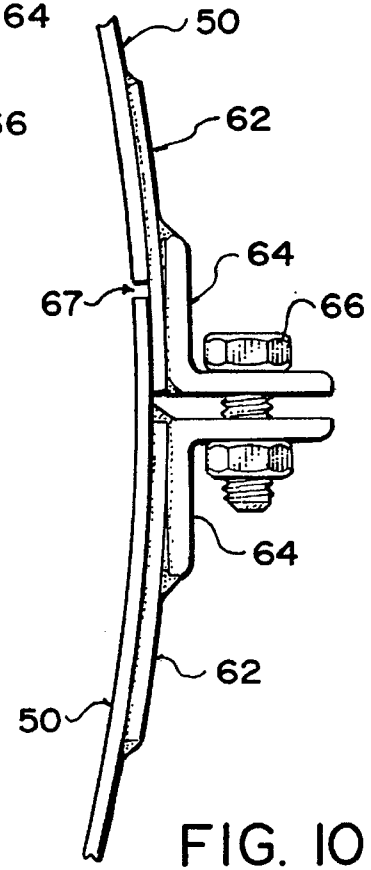
FIG. 10 illustrates a top view of a girdle and connection joint for the top portion of a combustion chamber.
Figure 8:
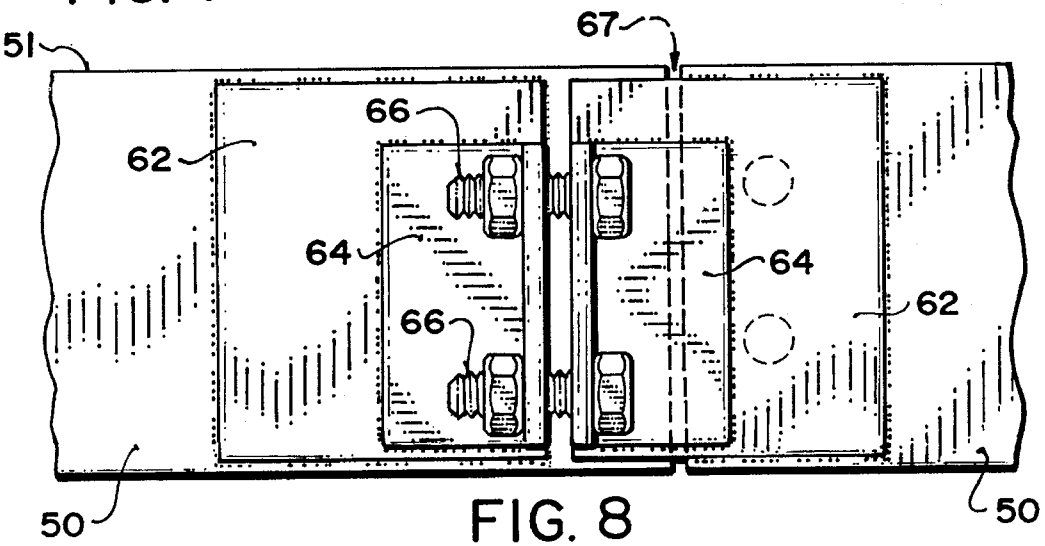
FIG. 8 illustrates a side detail of a girdle for the top portion of a combustion chamber.

FIGS. 8, 9 and 10 illustrate the securing mechanism that is used to hold the outer cylindrical girdle 50 of the "doughnut", at any particular specified elevation, to adjust flow of the cooling water. The outer reinforcing bands 62 are welded to the girdle 50 and angle irons 64, which are pulled together by bolts 66. This structure enables the girdle 50 to be tightened by means of gap 67 so that the gap 63 becomes very small. The elevation of cylindrical girdle 50 can be adjusted relative to the top plate 38 in order to adjust the opening of gap 60, and in turn the flow of cooling water down the exterior walls of the combustion chamber 4.

Figure 11:
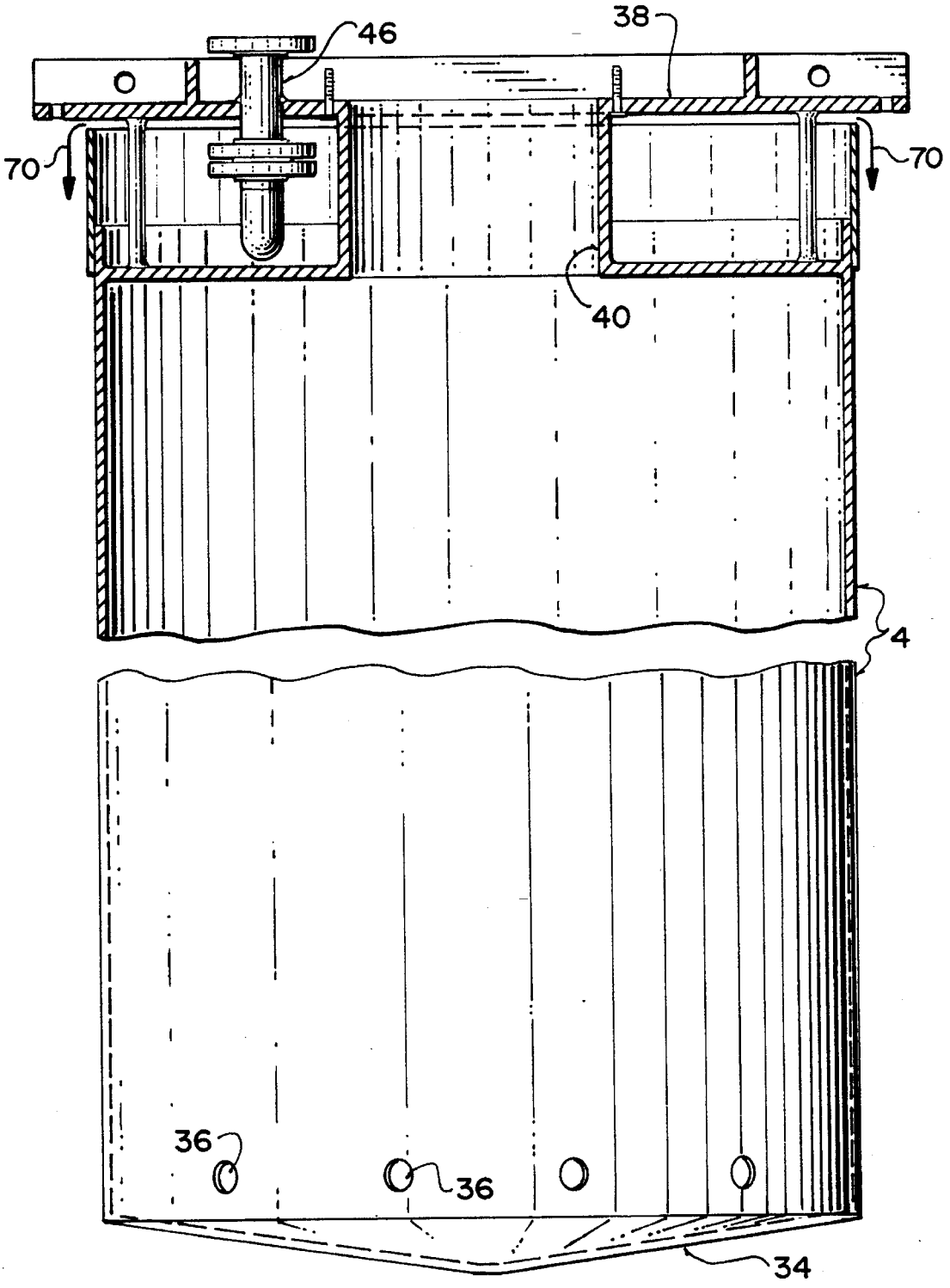
FIG. 11 illustrates a truncated side view of the top and bottom of an alternative embodiment of combustion chamber.
Figure 12:
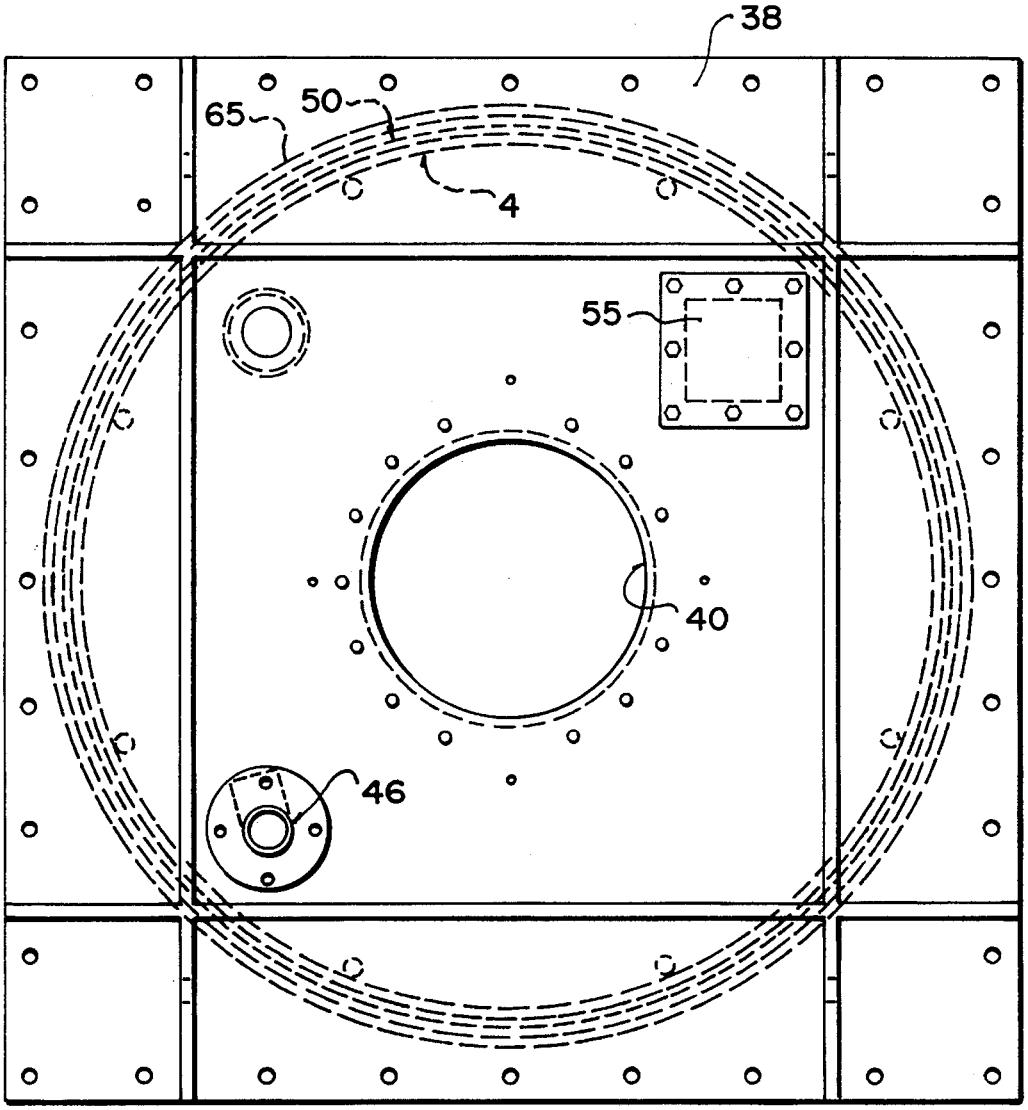
FIG. 12 illustrates a plan view of an alternative embodiment of combustion chamber.

FIG. 11 illustrates a truncated side section view of the top and bottom of an alternative embodiment of combustion chamber. FIG. 12 illustrates a plan view of the alternative embodiment of the combustion chamber. The embodiment of combustion chamber illustrated in FIGS. 11 and 12 is simpler in construction than the embodiment disclosed in the previous drawings. The base of the combustion chamber 4 has two elevations of ports 36, rather than three elevations. Also, the construction of the "doughnut" for the cooling water system is simplified. However, the basic function of cooling the upper outer walls of the combustion chamber 4 is the same. Water for cooling spills over the upper lip of the cylindrical outer girdle 50.

Advantages of the Submerged Combustion System

The submerged combustion system has a large number of advantages over other liquid heating systems. (1) Over 90% efficiency. (2) Uniform temperatures throughout the solution in the tank due to strong solution agitation. (3) Compact design solution holding tank, depending on solution type, permits combustion tank to act as a reaction vessel, due to the strong mixing action developed. (4) The combustion tank is not pressurized and is designed so that maintenance personnel can easily enter tank and perform maintenance tasks. (5) Operation of the submerged combustion system does not require a Certified Operating Engineer. (6) Solution discharge temperature is controlled with a single feedback loop, so that expensive and troublesome controls and valves are not required. (7) Simple, safe, and reliable design provides years of trouble free service.

The submerged combustion system can be available as a standardized pre-packaged unit with heat inputs up to 20-million Btu per hour. The system capacity selected determines whether single or multiple burner units are required. Generally, single burner units are sufficient up to 10-million Btu per hour, whereas multiple burner units are required for systems generating more than 10-million Btu per hour. Field erection is required for units over 20-million Btu per hour.

The burner design selected should provide complete and efficient mixing of the fuel and combustion air. In larger applications, multiple burners can be readily installed at the top of the tank. The combustion chamber should be sized relative to the tank dimensions to ensure that relatively high velocities are obtained for proper unit operation. The submerged combustion system should be controlled with Programmable Logic Control (PLC) based flame safeguard systems. The totally automatic control system enables the system to be started with a simple "Start" button.

Submerged Combustion Operation

During system start-up, a five-second automatic pre-ignition purge evacuates liquid from the combustion chamber. The PLC-based burner management system supervises and controls all interlocks and upon proof of pilot ignition, permits main burner ignition. During operation, the heat input is controlled by sensing the temperature of the liquid at the point of discharge. The liquid level in the tank is constantly monitored and interlocked by means of an air bubble liquid level sensing system.

In an alternative grid system, the tanks 2 can be excluded and the grid array of combustion chambers 4 and tanks can be partially submerged directly into the solution to be heated. In that case, the hot combustion gases are expelled from the bottom ports 36 in the combustion chambers 4 into the solution in the tanks 2 and are exhausted through outlets 30. The heated solution is pumped from the tanks, while cold solution is returned to the pond and into the tanks.

As will be apparent to those skilled in the art in the light of the foregoing disclosure, many alterations and modifications are possible in the practice of this invention without departing from the spirit or scope thereof. Accordingly, the scope of the invention is to be construed in accordance with the substance defined by the following claims.

What is claimed is:

1. A submerged combustion system comprising:

(a) tank means for holding liquid, the tank means having a liquid inlet and a liquid outlet, and an exhaust gas outlet;

(b) a closed bottom combustion chamber means positioned in at least a portion of an interior of the tank means;

(c) means in the combustion chamber means for enabling fuel and air to be introduced into an interior of the combustion chamber means and being ignited in the interior of the combustion chamber means to create a hot gaseous combustion product in the interior of the combustion chamber;

(d) a plurality of port means located in a lower region of the combustion chamber means for enabling the hot gaseous combustion product to be exhausted from the interior of the combustion chamber into liquid in the tank means and ultimately out through the exhaust gas outlet;

(e) means for controlling level of liquid in the tank means so that the liquid is above the port means and below a top of the combustion chamber means and a top of the tank means, the hot gaseous combustion product passing from the interior of the combustion chamber means through the plurality of port means into the liquid and heating the liquid, the liquid heated by the hot gaseous combustion product being withdrawn from the tank means through the liquid outlet, and unheated liquid being introduced into the tank means through the liquid inlet;

(f) cooling liquid means located at an upper region of the combustion chamber means, an exterior surface of the combustion chamber means extending above the level of the liquid in the tank means being cooled by a continuous downwardly flowing curtain of cooling liquid which is introduced into the cooling liquid means located in the upper region of the combustion chamber, and spills by gravity over top exterior edges of the combustion chamber means and runs down outer walls of the combustion chamber means until the cooling liquid reaches and joins the liquid being heated by the hot gaseous combustion product;

(g) the cooling liquid means is a hollow circular chamber and the cooling liquid is introduced into the hollow circular chamber at the upper region of the combustion chamber means by a pipe which causes the cooling liquid to circulate in the hollow circular chamber in a vortex pattern; and (h) elevation of the hollow circular chamber can be adjusted relative to elevation of the combustion chamber means.

2. A system as claimed in claim 1 wherein the cooling liquid means is constructed so that it has a hollow toroidal configuration created by a pair of parallel horizontal circular plates, with respective circular openings in the respective centers thereof, the horizontal circular plates having a common radius, and being spaced vertically from and axially aligned with one another, and the coincident exterior circumferences of the two parallel horizontal circular plates being joined by an outer hollow vertical cylinder, and the coincident circumferences of the circular openings in the centers of the two horizontal circular plates being joined by an inner hollow vertical cylinder of smaller diameter than the outer hollow vertical cylinder, the inner hollow vertical cylinder and the outer hollow vertical cylinder being arranged in an annular configuration to one another.

3. A system as claimed in claim 2 wherein nozzle means for combining fuel and air for combustion in the combustion chamber means is positioned in the interior of the inner hollow cylinder.

4. A system as claimed in claim 2 wherein the cooling liquid is water which is introduced into an interior annular volume of the annular shaped cooling liquid means and exits over a lip around a top of an outer circumference of the outer hollow cylinder and the cooling water flows down an outer surface of the combustion chamber means.

5. A system as claimed in claim 4 wherein the elevation of the lip can be adjusted to regulate the amount of cooling liquid flowing over the lip.

* * * * *